United States Patent [19]

Ahlquist

[11] 4,014,534

[45] Mar. 29, 1977

[54] CHAIN REPAIR WORKBENCH

[75] Inventor: Melvin J. Ahlquist, Sioux City, Iowa

[73] Assignee: City of Sioux City, Iowa, Sioux City, Iowa

[22] Filed: Sept. 10, 1975

[21] Appl. No.: 611,986

[52] U.S. Cl. ..... 269/47; 269/208; 269/321 W

[51] Int. Cl.[2] ..... B25B 11/02

[58] Field of Search ..... 269/37, 43, 25, 90, 269/47, 208, 265, 321 W; 254/67, 54; 59/34

[56] References Cited

UNITED STATES PATENTS

| | | | |
|---|---|---|---|
| 1,430,226 | 9/1922 | Goodreau | 269/208 |
| 3,030,766 | 4/1962 | Slipp | 269/47 X |
| 3,220,691 | 11/1965 | Dudley | 269/208 |

*Primary Examiner*—Al Lawrence Smith
*Assistant Examiner*—Robert C. Watson
*Attorney, Agent, or Firm*—Roylance, Abrams, Berdo & Kaul

[57] ABSTRACT

A special purpose workbench for holding chain assemblies in the nature of tire chains. A table with a flat top has a vertical transverse wall located near one end and movable to a number of different locations. A similar wall at the opposite end of the table is fixed in one embodiment and movable in other embodiments. The walls are provided with hooks to engage the ends of longitudinal chain sections between which transverse chain sections extend. An apparatus for determining the location of one wall includes a central bar having holes, the wall having a flange with matching holes through which a locking pin can be placed. Guide brackets are provided at the ends of the wall to engage parallel side edges of the table. The means for adjusting the other wall includes either a threaded shaft engaging a threaded member on the wall or a fluid-actuated piston and cylinder assembly with control means. When the second wall is movable, guide means engaging the table edges are provided.

9 Claims, 14 Drawing Figures

CHAIN REPAIR WORKBENCH

This invention relates to a workbench for holding chain assemblies to be repaired, particularly chain assemblies of the type having two or three longitudinal chain sections and a plurality of transverse chain sections extending between the longitudinal sections.

In vehicle maintenance facilities, such as the facilities of a municipal truck maintenance center, and particularly in such a facility in a snowy region, a significant problem is presented in maintaining and repairing chain assemblies such as tire chains which are to be fitted on trucks and other vehicles used for snow removal and other road maintenance. Generally speaking, snow chains used on three trucks include either two or three longitudinal chain portions, these being the portions which extend around the tires of the vehicle in a circular fashion when applied to the vehicle. Transverse chain portions extend between these circular portions and lie against the tire tread to provide traction. When links are broken or become severely worn and need to be replaced, it is common practice to stretch the chain assembly out on a floor and use various well known tools to remove damaged links and apply replacement links.

However, the forces involved in removing old links and applying new ones is significant, and it is extremely difficult to maintain the chain in its proper position while removing and applying those links. Thus, it commonly happens that a section of the chain becomes twisted at some point in the process before the new link is applied, resulting in a twist being incorporated into the chain when it is applied on the vehicle. This results in additional stress in the chain links, shortening the useful life of the chain assembly between repairs.

An object of the present invention is to provide an apparatus for holding chain assemblies of the type described so that they can be quickly and easily repaired and so that the chains thereof are maintained in proper orientation during the repair operation.

A further object is to provide a chain holding apparatus which is easily adjustable, longitudinally as well as transversely, to accommodate chains of different sizes which are usable on vehicles of various sizes.

It is a further object to provide a chain-holding apparatus which is relatively simple, easy to fabricate and which is simple to adjust and use.

Briefly described, the apparatus of the present invention includes a table having a substantially flat top surface and parallel side edges, a first wall extending transversely across the surface near one end thereof, means for supporting the wall on the top surface, hook means attached to the first wall at spaced locations for engaging an end of the longitudinal sections of chain assemblies to be prepared, a second wall, guide means attached to second wall for engaging the side edges of the table and for movably retaining the second wall at a position spaced from the first wall but permitting longitudinal movement along the surface, second hook means attached to the second wall for engaging the other ends of the longitudinal chain sections, and means for locking the second wall at any one of a plurality of longitudinal positions to establish a predetermined desired spacing between the first and second walls.

The guide means can include bracket members which extend across a portion of the top surface and along the edges of the table. The locking means can include a central bar extending longitudinally on the top of the table, the bar having holes therethrough, and a flange carried by the second wall, the flange having an opening mating with openings in the bar to permit insertion of a locking pin to establish a desired longitudinal position of the second wall.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
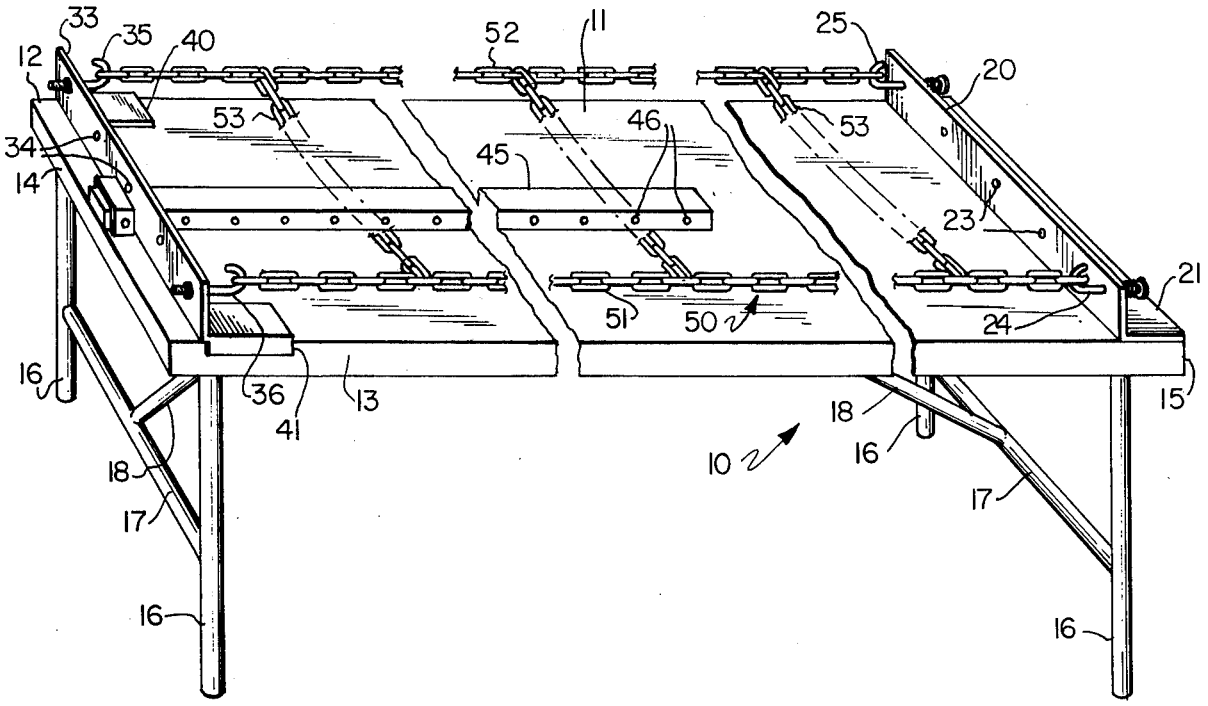
FIG. 1 is a foreshortened perspective view of one embodiment of an apparatus according to the invention.

FIGS. 1–4 will first be discussed, these figures showing a first embodiment of an apparatus according to the invention in which there is provided a table indicated generally at 10 having a work portion with a top surface 11, parallel side edges 12 and 13 and ends 14 and 15. The top portion is supported by a leg structure of rather conventional nature having legs 16, crossbraces 17 and diagonal support braces 18, the exact arrangement of the legs and braces being optional and forming no part of the present invention.

The table top 10 can be constructed from any convenient material such as wood or metal and, in its simplest form, simply constitutes a slab of substantially rigid material. At one end of table 10 is provided a first upstanding wall 20 which, in the embodiment of FIG. 1, is one leg of an L-shaped member, the other leg 21 of which is fixedly attached to surface 11 of the table top. Wall 20 is substantially vertical and extends transversely across surface 11. A plurality of openings 23 pass through wall 20 to receive hooks such as those shown at 24 and 25. Hooks 24 and 25 can be inserted through any two of openings 23, depending upon the size of the chain 10 be worked on, which size determines the desired spacing between hooks.

Figure 4:
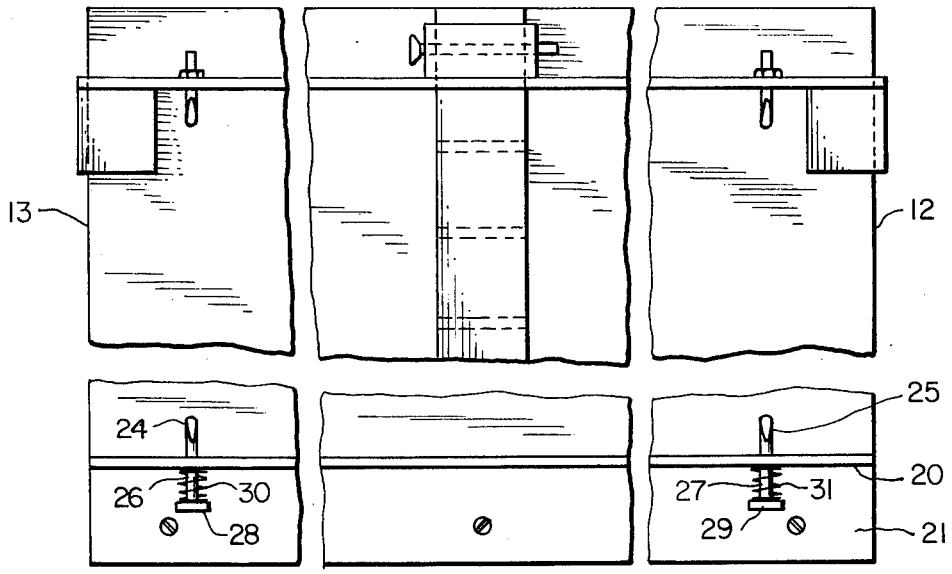
FIG. 4 is a foreshortened top plan view of the apparatus of FIGS. 1–3.

As best seen in FIG. 4, hooks 24 and 25 have straight shank portions 26 and 27 which extend through wall 20 and terminate in enlarged heads 28 and 29 which can, for example, be conventional internally threaded nuts on externally threaded end portions of the straight shanks. Spiral compression springs 30 and 31 surround the straight shank portions, acting between wall 20 and enlarged heads 28 and 29, tending to urge the hook portions toward wall 20.

Figure 2:
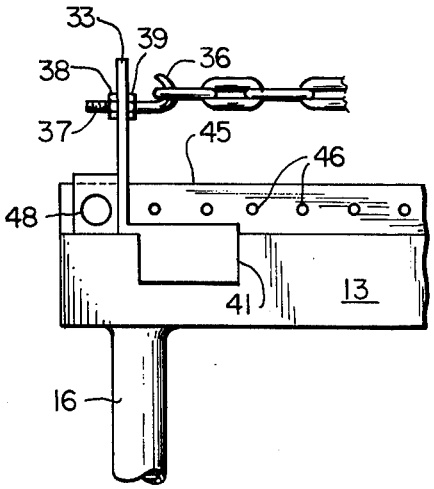
FIG. 2 is a partial side elevation of the apparatus of FIG. 1.
Figure 3:
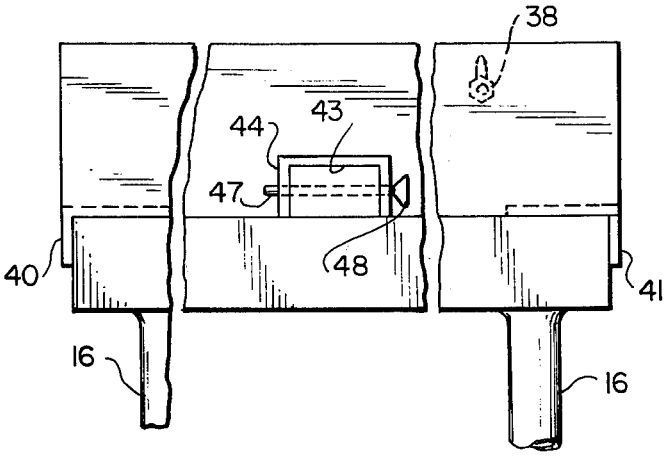
FIG. 3 is a foreshortened end elevation of the apparatus of FIGS. 1 and 2.

At the other end of the table there is provided an upstanding wall 33 which is provided with a plurality of openings 34, the spacing of openings 34 being substantially identical to the spacing of openings 23 in wall 20. Hooks 35 and 36 extend through two of these openings to engage the other ends of the chain assembly longitudinal sections. While the hooks through wall 33 can also be provided with springs as in the case of hooks 24 and 25, there is no critical need to have the springs at both ends. Accordingly, hooks 35 and 36 can be firmly mounted in wall 33 as depicted in FIG. 2 wherein hook 36 is shown having an externally threaded straight shank portion 37 with internally threaded nuts 38 and 39 engaging the threads on opposite sides of wall 33.

It should be noted that the first hook means comprising hooks 24 and 25 can also include a third hook centrally located between the outer hooks to accommodate a chain having three longitudinal portions as might be used in connection with a dual wheel vehicle. Similarly, the second hook means through second upstanding wall 33 can include a central hook to engage the other end of the central longitudinal chain section.

Wall 33 is supported on table 10 by L-shaped members 40 and 41, each L-shaped member including a horizontal portion which extends partway across and rests on surface 11 and a downwardly extending portion which is adjacent to one of side edges 12 and 13. Members 40 and 41 are fixedly attached, as by welding, to wall 33 with the inwardly facing surfaces of members 40 and 41 being parallel to each other and to the parallel side edges of the table. Clearly, members 40 and 41 can also be integrally formed with wall 33 by a bending operation. Thus, wall 33 rests on the table and is guided for longitudinal movement parallel to itself along the length of the table.

Wall 33 is provided with a central opening 43 which is, in the embodiment shown in FIGS. 1–4, rectangular in shape. A three-sided flange member 44 surrounds the central opening on three sides thereof, the opening and the three-sided flange opening downwardly.

The flange protrudes longitudinally from wall 33 toward end 14 of the table. A central guide and locking bar 45 is fixedly attached to surface 11 of table 10 and extends approximately down the center of surface 11 in its longitudinal direction. Bar 45 is rectangular in shape and is dimensioned to be received in opening 43 and within flange 44, and is provided with a plurality of horizontal transverse openings 46. Openings 46 are essentially evenly spaced apart along the length of the bar and are dimensioned to receive a locking pin 47. The downwardly extending side portions of flange 44 are also provided with holes through which pin 47 can extend. Thus, at any one of a plurality of selected positions, wall 33 can be locked in place by aligning the openings through flange 44 with an opening 46 in bar 45 and inserting the locking pin. Pin 47 is provided with an enlarged head 48 by which the pin can be easily grasped.

In use, a chain assembly indicated generally at 50 and having longitudinal chain sections 51 and 52 and transverse sections 53 is laid on surface 11 of table 10 in preparation for repair. The chain is straightened and untwisted so that the various sections thereof are in their proper orientation. Wall 33 is moved to the appropriate longitudinal position for the specific size of the chain employed and hooks 24, 25, 35 and 36 are placed in the appropriate opening, if they are not already so located. As previously indicated, a third hook can also be inserted in each wall if a third longitudinal chain section is present. With locking pin 47 inserted through the openings in flange 44 and bar 45 to hold wall 33 in its appropriate place, one end of each of longitudinal sections 51 and 52 is then engaged over hooks 35 and 36. Springs 30 and 31 are then compressed by pressing in enlarged heads 28 and 29, and the other ends of longitudinal sections 51 and 52 are engaged over hooks 24 and 25, respectively. The chain is then held in a suitable position for maintenance and repair as necessary, without difficulties of twisting or scrambling of the chain assembly portions.

A feature of the present invention, which is not specifically illustrated in the drawings, but which can be used in conjunction with this invention is the provision of calibrations marked on the surface of the table or on guide bar 45. Tire chains of the type with which the apparatus of the present invention can be used are of various lengths, depending upon the size of the tire with which they are to be used. For example, an E78×15 utilizes 58 in. of 3/16 in. chain for the side chains, i.e., the longitudinal chain portions 51 and 52 in FIG. 1. The transverse portions are 11 in. lengths of the same size chain. A G78×15 tire uses 68 in. of side chain with the cross link portions being 13.5 in. in length. An H78×15 tire uses 70 in. of side chain with 13.5 in. crosslengths. From this, it will be recognized that specific ones of holes 46 in guide bar 45 could be marked to indicate the length of the side chain which can be accommodated with wall 33 positioned so that the pin passes through that opening. Similarly, openings 34 could be marked to indicate which pairs of holes should be used to accommodate certain lengths of crosslinks.

In addition, trucks and heavier equipment utilize larger size chains, for example, a 9:00×20 truck tire commonly uses a 5/16 in. chain having an 88 in. side chain length and 20 in. crosslink length. A 10:00×20 uses 94 in. of 5/16 in. side chain with a 20 in. crosslink. These latter tire sizes are commonly mounted in dual-wheel fashion, using dual chains which incorporate the center chain and two sets of crosslinks. Thus, the overall width is 41 in. The dimensions of a table to accommodate chain of this size would obviously be a minimum of 41 in. with openings at appropriate points.

Figure 5:
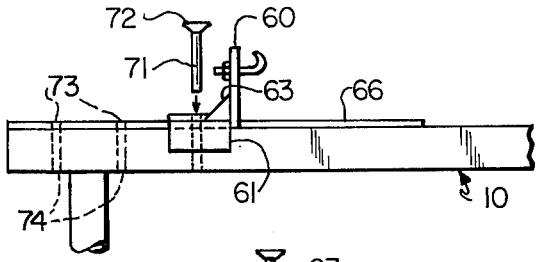
FIG. 5 is a partial side elevation of a second embodiment of an apparatus according to the invention.
Figure 6:
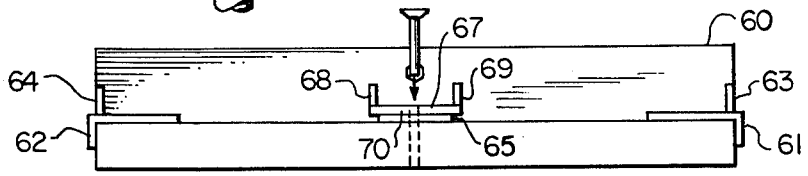
FIG. 6 is a foreshortened end elevation of the embodiment of FIG. 5.
Figure 7:
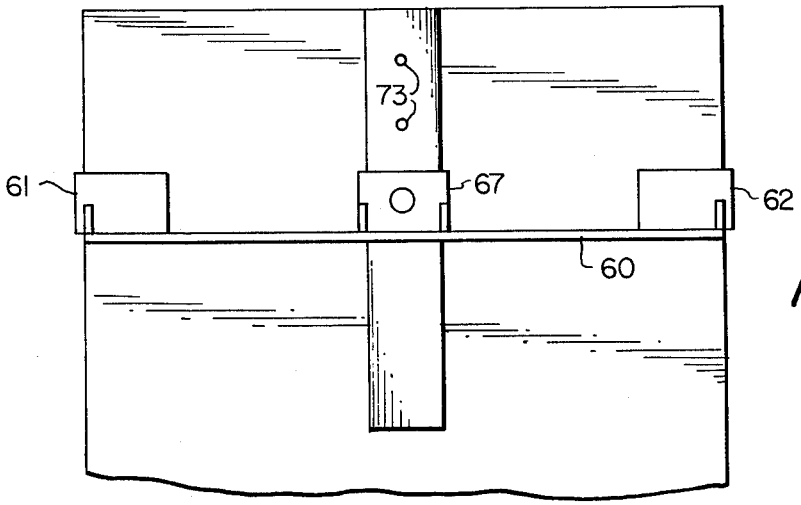
FIG. 7 is a top plan view of the embodiment of FIGS. 5 and 6.

An alternative embodiment of the apparatus shown in FIGs. 1–4 is shown in the partial elevations of FIGS. 5 and 6. In the embodiment of FIGS. 5 and 6, it is contemplated that the structure of wall 20 and its associated components would remain the same as in FIGS. 1–4 or the alternative structures to be hereinafter described could be used. Accordingly, that portion of the apparatus will not be described in connection with this embodiment. That portion which is modified is illustrated in FIGS. 5–7 and includes the locking mechanism to position the movable wall. In this embodiment the second upstanding wall is identified as 60, this wall supporting hook means as previously described. Wall 60 is provided with L-shaped members 61 and 62 which are substantially identical to L-shaped members 40 and 41 but extend in the opposite direction from wall 60. Diagonal brace members 63 and 74 can be provided to add rigidity to the structure. The function of the L-shaped members is, however, substantially identical to that described with reference to wall 33.

Wall 60 is provided with a downwardly opening rectangular recess 65 near the center of wall 60, this recess being dimensioned to receive a relatively thin rectangular locking strip 66 which extends longitudinally from one end of table 10 in a manner similar to locking bar 45. A longitudinally extending flange 67 which extends from wall 60 in the same direction as members 61 and 62 just above opening 65. Flange 67 can be provided with diagonal brace members 68 and 69 to add to the rigidity of the flange. A vertical opening 70 extends through flange 67 to receive a locking pin 71 which has an enlarged head 72.

Strip 66 is provided with a plurality of substantially equally spaced vertical holes 73 which are dimensioned to receive pin 71. Similarly, the body of table 10 is provided with a plurality of similarly dimensioned holes 74, holes 74 being aligned with holes 73 in strip 66.

As in the case with wall 33, wall 60 is longitudinally movable, being guided and maintained in a relationship perpendicular to the parallel side edges of the table by members 61 and 62. In order to fix the wall in a specific location, hole 70 is aligned with a selected one of holes 73 and, therefore, holes 74, and locking pin 71 is inserted into the aligned holes. The wall is thereby firmly fixed in the desired position.

It will be observed that strip 66 can be fabricated from metal, particularly if the body of table 10 is wood to avoid undesirable wear of holes 74. If table 10 is fabricated from metal, strip 66 could, strictly speaking, be eliminated. However, providing strip 66 in a mating relationship with opening 65 in wall 60 has the additional advantage of providing a central guide for plate 60, maintaining it in its properly aligned position.

Figure 8:
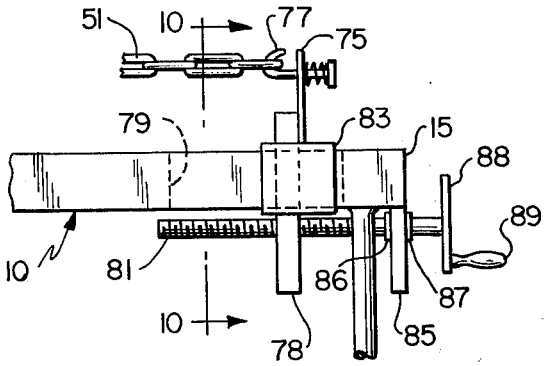
FIGS. 8 and 9 are partial side elevation and top plan views, respectively, of a further embodiment of an apparatus according to the invention.
Figure 10:
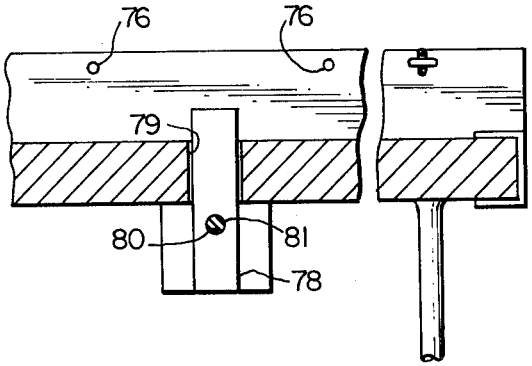
FIG. 10 is a partial foreshortened section along lines 10—10 of FIG. 8.
Figure 9:
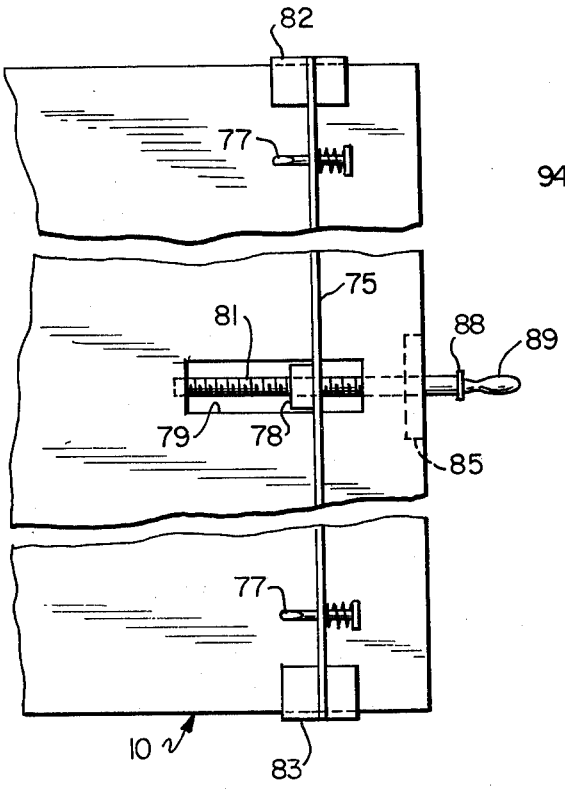

A third embodiment of an apparatus according to the invention shown in FIGS. 8–10, this embodiment dealing with the end of the apparatus equivalent to that supporting wall 20 in the embodiment of FIGS. 1–4. In discussing this embodiment, it should be borne in mind that the embodiment of FIGS. 8–10 can be used in conjunction with a wall structure at the other end of the table like that shown in FIGS. 1–4 or a structure having the locking arrangement of FIGS. 5–7.

As shown in FIGS. 7–10, the apparatus includes an upstanding transverse wall 75 having a number of openings 76 therethrough to receive hooks 77, the hooks being substantially identical in structure to hooks 24 and 25. Wall 75 is fixedly attached to a rigid member 78 which extends downwardly below the bottom edge of wall 75 and protrudes through a longitudinally extending elongated slot 79 in the body of table top 10. Member 78 is penetrated by an internally threaded opening 80 which receives an externally threaded shaft 81.

Wall 75 is fixedly attached to guide members 82 and 83, each of which comprises a generally U-shaped bracket member which faces inwardly toward table 10 and surrounds and engages an edge thereof, the inwardly facing surfaces thereof being parallel with each other and with the parallel edges of table 10.

A downwardly extending support member 85 is fixedly attached to end 15 of table 10, member 85 having an opening therethrough to receive an unthreaded portion of shaft 81. Shaft 81 is provided with annular recesses axially spaced apart by a distance slightly greater than the thickness of member 85, the recesses being provided to receive snap rings 86 and 87 which restrain shaft 81 against axial movement. A crank arm 88 and handle 89 are provided at the end of shaft 81 by which the shaft can be manually rotated. The purpose of the apparatus of FIGS. 8–10 is to provide length adjustment in conjunction with the stepwise adjustment of one of the locking mechanisms shown in FIGS. 1–7. In use, member 78 and wall 75 are positioned in a generally central location in slot 79 by rotation of crank 89 and shaft 81, the rotation of the shaft causing member 78 to move axially with respect to shaft 81. The chain assembly is then placed on the table and the second end wall 33 or 60 is positioned and the locking pin is inserted to retain it in position. At that point, the spacing between the end walls is less than the total length of longitudinal chain members 51 or 52. The ends of the longitudinal chain sections are then engaged over the hooks carried by both end walls and crank handle 89 is again manually rotated, this time in the opposite direction, to move wall 75 away from the other end wall, stretching the chain to the desired position. Repair can then be conveniently effected.

Figure 11:
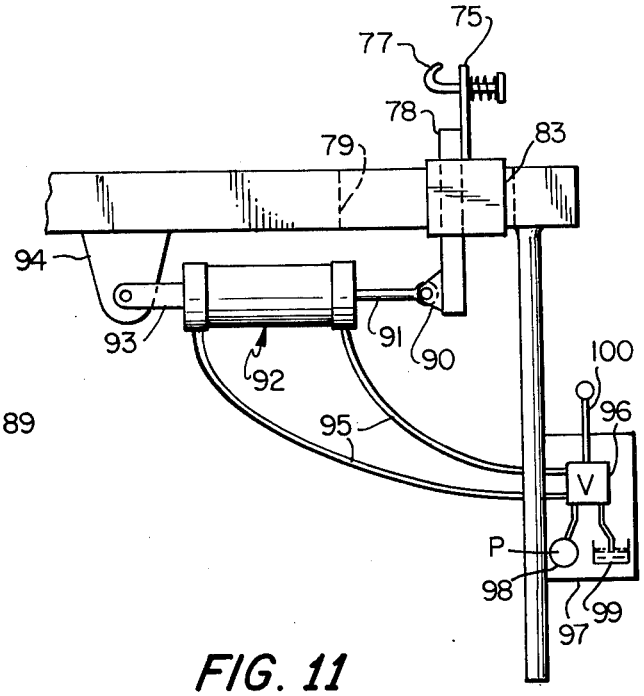
FIG. 11 is a side elevation of yet another embodiment of an apparatus according to the invention.

FIG. 11 shows still another embodiment of the apparatus, this embodiment being similar in a portion of its structure to that of FIGS. 8–10. Thus, there is provided a wall 75 with end guide means 82 and 83, hook means 77 and a rigid member 78 fixedly attached to and depending downwardly from wall 75 through a slot 79 in the table.

However, instead of a threaded member being connected to member 78, there is provided a bracket 90 which is pivotally attached to a piston rod 91 which is connected to a piston within a piston and cylinder assembly indicated generally at 92. The opposite end of the cylinder of this assembly is provided with a link at 93 which is pivotally connected to a bracket member 94 connected to the underside of table 10. Pneumatic or hydraulic lines 95 are connected to the opposite ends of the cylinder and to a valve 96 contained within a housing 97 attached to, for example, the supporting structure for table 10. Housing 97 also includes a source of fluid under pressure 98 such as a pneumatic or hydraulic pump and a vent or reservoir 99, the pump and vent being connected to valve 96. The valve is preferably manually actuated, as by a valve handle 100 to control the position of the valve and to control the delivery of fluid pressure, selectably, through one of conduits 95 to a selected end of piston and cylinder assembly 92. As will be evident to those skilled in the art, proper positioning of the valve delivers pressure to one end of the piston and cylinder while venting the other end, thereby driving the piston and its piston rod 91 in one direction or the other.

The operation of this apparatus is substantially identical to that described with reference to FIGS. 8–10 in that pressure is delivered to the piston and cylinder assembly at the end closest to member 78 to drive wall 75 toward the second wall at the other end of the table. The chain is then positioned and engaged on the hooks, whereupon pressure is delivered through the other conduit to drive the piston in a direction to extend the chain assembly.

The specific kind of fluid pressure employed, the specific value structure and other components of the hydraulic system used are generally conventional in nature and does not specifically form a separate part of the present invention. Accordingly, no further discussions of this aspect of the apparatus is deemed necessary.

Figure 12:
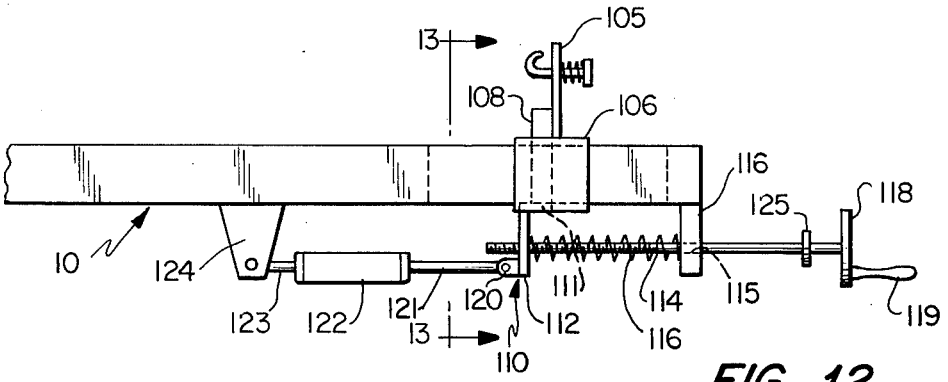
FIG. 12 is a partial side elevation of a further embodiment of an apparatus according to the invention.
Figure 13:
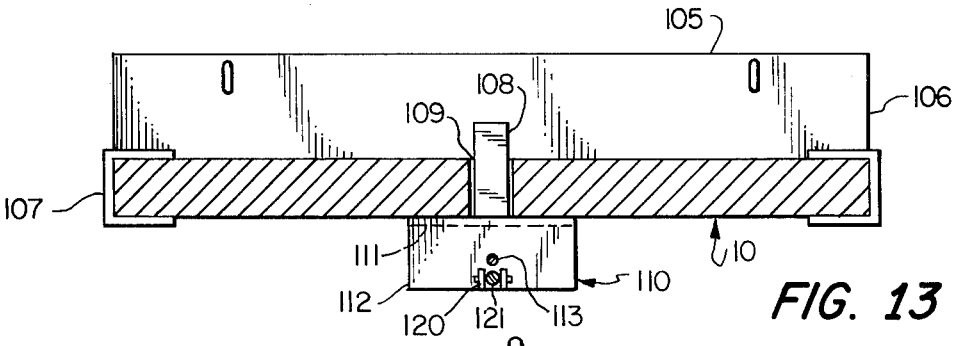
FIG. 13 is a vertical section along lines 13—13 of FIG. 12.
Figure 14:
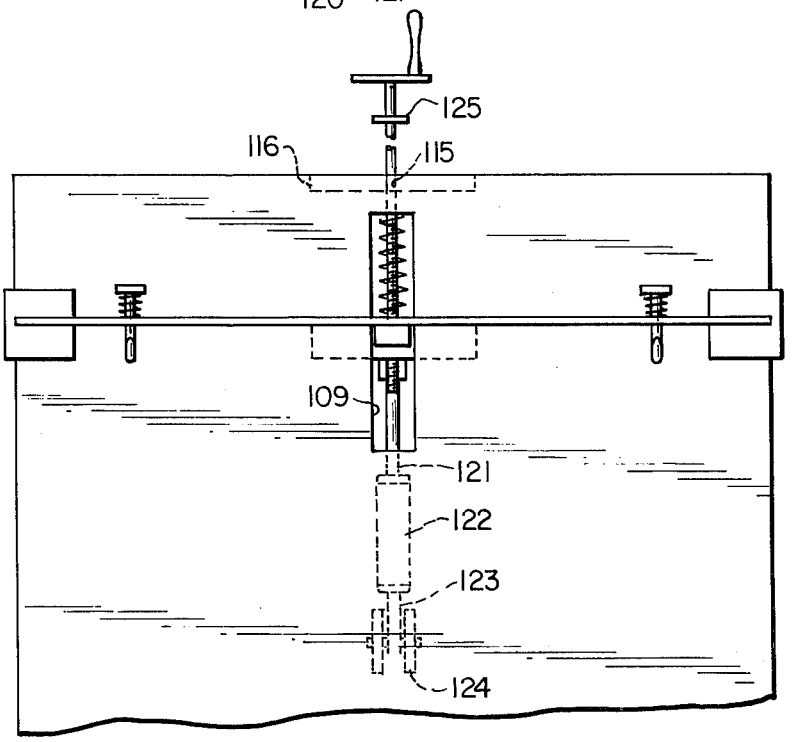
FIG. 14 is a partial top plan view of the apparatus of FIGS. 12 and 13.

FIGs. 12–14 show an apparatus which combines the advantages of the hydraulic positioning mechanism of FIG. 11 and the crank-operated mechanical positioning apparatus of FIGS. 8–10. The table 10 is again provided with an upstanding transverse wall 105 which is supported on end brackets 106 and 107 are U-shaped and which opens toward each other, the end brackets surrounding the parallel side edges of the table. Wall 105 is attached to the brackets by welding or can be integrally formed therewith. Wall 105 is provided with chain-retaining hooks as described in connection with the embodiments of FIGS. 1–11. A rigid actuating and guide member 108 is attached to and is movable with wall 105 and depends downwardly through a slot 109 in table 10, slot 109 being rectangular and elongated in the longitudinal direction of the table. Member 109 extends downwardly through the table and terminates in a plane containing the lower surface of the tabletop and is fixedly attached to an L-shaped bracket member 110, the horizontal leg 111 of which extends transversely across the table on either side of the slot and rides against the undersurface of the table. The downwardly extending leg 112 of bracket 110 includes a centrally located internally threaded opening 113 which receives an externally threaded adjustment shaft 114. Shaft 114 extends horizontally through a smooth, non-threaded opening 115 in a depending bracket member 116 which is rigidly attached to table 10. A compression spring 117 surrounds that portion of shaft 114 which lies between leg 112 and member 116 and acts against those two members, tending to urge them apart. A crank arm 118 is attached to the distal end of shaft 114 and a crank handle 119 is attached to arm 118 so that shaft 114 is rotatable.

Below opening 113 leg 112 is provided with a bracket 120 which is pivotally connected to a piston rod 121, rod 121 being connected to the piston of a piston and cylinder assembly 122. The cylinder thereof is connected to a link 123 which is pivotally connected to a bracket 124 mounted on the undersurface of table 10. The piston and cylinder assembly 122 can be connected through suitable hydraulic supply and control means, such as that shown in FIG. 11, these not being illustrated in FIGS. 12–14 for simplicity.

An annular stop member, such as a washer 125 is fixedly attached to shaft 114 between crankarm 118 and member 116 to limit the axial movement of shaft 114 in one direction. It will be observed that the distance between washer 125 and the distal end of the threaded portion of shaft 114 should be at least as great as the longitudinal dimension of slot 109.

In this embodiment of the apparatus, the hydraulic and threaded mechanical adjustment mechanisms would be normally used alternatively, rather than concurrently. If hydraulic power is to be used, power is applied to the piston and cylinder apparatus to retract that apparatus for application of a chain on the retaining hooks, after which the hydraulic apparatus would be extended, as described with reference to FIG. 11, to stretch the chain to its repair position.

However, in the event of a failure of the hydraulic apparatus, or in the event of the lack of suitable power to utilize the hydraulic apparatus at the worksite, the mechanical apparatus could be employed such that rotation of crank 119 adjusts the distance between leg 112 and member 116, thereby positioning upstanding wall 105. As will be seen, when the hydraulic portion of the apparatus is not being used, spring 116 tends to urge leg 112 away from member 116, this distance being a function of the placement of washer 125 and the position of leg 112 on the threaded portion of shaft 114.

While certain advantageous embodiments have been chosen to illustrate the invention, it will be understood by those skilled in the art that various changes and modifications can be made therein without departing from the scope of the invention as defined in the appended claims.

What I claim is:

1. An apparatus for holding chain assemblies to be repaired, the chain assemblies being of the type having at least two longitudinal chain sections and a plurality of transverse chain sections extending between said longitudinal sections, the apparatus comprising a table having a substantially flat top surface and parallel side edges;

a first upstanding wall extending transversely across said surface near one end thereof;

means for supporting said first wall on said top surface;

first hook means attached to said first wall at transversely spaced apart locations for engaging one end of each of the longitudinal chain sections;

a second upstanding wall;

guide means fixedly attached to said second wall for engaging the side edges of said table and for movably retaining said second wall for longitudinal movement along said surface while maintaining said second wall substantially parallel to said first wall;

second hook means attached to said second wall for engaging the other ends of the longitudinal chain sections, said second hook means being attached at locations spaced apart by a distance substantially equal to the spacing of said first hook means; and means for locking said second wall at any one of a plurality of longitudinal positions to establish a predetermined spacing between said first and second walls, said means for locking including a bar extending longitudinally on said top surface from one end thereof parallel to said side edges, said bar having means defining a plurality of openings at longitudinally spaced intervals;

means in said second wall defining an opening therethrough dimensioned to mate with said bar;

a flange attached to and movable with said second wall along said bar, said flange being adjacent said opening in said second wall and having an opening therethrough alignable with a selected one of said openings in said bar; and a locking pin insertable into said openings in said flange and said bar to establish a longitudinal position of said second wall.

2. An apparatus according to claim 1 wherein said second wall comprises a rectangular plate, and said guide means includes first and second L-shaped members attached to the lower end corners of said plate with one leg of each L-shaped member parallel to the bottom edge of said plate and the other leg of each member extending downwardly along the side edges of said table.

3. An apparatus according to claim 1 wherein the openings in said bar and said flange define horizontal paths for insertion of said pin.

4. An apparatus according to claim 1 wherein the openings in said bar and said flange define vertical paths for insertion of said pin.

5. An apparatus for holding chain assemblies to be repaired, the chain assemblies being of the type having at least two longitudinal chain sections and a plurality of transverse chain sections extending between said longitudinal sections, the apparatus comprising a table having a substantially flat top surface and parallel side edges;

a first upstanding wall extending transversely across said surface near one end thereof;

means for supporting said first wall on said top surface including guide means fixedly attached to said first wall for engaging said side edges of said table to permit longitudinal movement of said first wall along said table;

an elongated threaded member mounted on said table for rotation about an axis parallel to the side edges; and a threaded body attached to and movable with said first wall, said threaded body being in mating threaded engagement, whereby rotation of said threaded member imparts longitudinal motion to said threaded body and said first wall;

first hook means attached to said first wall at transversely spaced apart locations for engaging one end of each of the longitudinal chain sections;

a second upstanding wall;

guide means fixedly attached to said second wall for engaging the side edges of said table and for movably retaining said second wall for longitudinal movement along said surface which maintain said second wall substantially parallel to said first wall;

second hook means attached to said second wall for engaging the other ends of the longitudinal chain sections, said second hook means being attached at locations spaced apart by a distance substantially equal to the spacing of said first hook means; and means for locking said second wall at any one of a plurality of longitudinal positions to establish a predetermined spacing between said first and second walls.

6. An apparatus according to claim 5 wherein said table includes means defining a longitudinally extending vertical opening therethrough along the path of travel of said first wall;

said threaded body includes a bar attached to said wall and depending through said vertical opening, the lower end of said bar having an internally threaded hole; and said threaded member includes an externally threaded shaft restrained against axial movement and having a crank handle thereon.

7. An apparatus according to claim 5 wherein said first and second walls include a plurality of holes, and said first and second hook means comprise individual hooks selectably mountable in said holes to accommodate chain assemblies having transverse chain sections of different lengths.

8. An apparatus for holding chain assemblies to be repaired, the chain assemblies being of the type having at least two longitudinal chain sections and a plurality of transverse chain sections extending between said longitudinal sections, the apparatus comprising a table having a substantially flat top surface and parallel side edges;

a first upstanding wall extending transversely across said surface near one end thereof;

means for supporting said first wall on said top surface including guide means fixedly attached to said first wall for engaging said side edges of said table to permit longitudinal movement of said first wall along said table;

first hook means attached to said first wall at transversely spaced apart locations for engaging one end of each of the longitudinal chain sections;

a second upstanding wall;

guide means fixedly attached to said second wall for engaging the side edges of said table and for movably retaining said second wall for longitudinal movement along said surface which maintain said second wall substantially parallel to said first wall;

second hook means attached to said second wall for engaging the other ends of the longitudinal chain sections, said second hook means being attached at locations spaced apart by a distance substantially equal to the spacing of said first hook means; and means for locking said second wall at any one of a plurality of longitudinal positions to establish a predetermined spacing between said first and second walls;

a rigid member fixedly attached to said first wall and extending below said table;

a piston and cylinder assembly connected between said table and said rigid member;

a source of fluid under pressure;

means for connecting said fluid under pressure to said piston and cylinder assembly; and valve means for controlling the application of said fluid under pressure to said piston and cylinder assembly for driving said rigid member and said first wall longitudinally along said table.

9. An apparatus according to claim 7 wherein said table includes means defining a longitudinally elongated vertical slot through said table, and said rigid member extends through said slot.

* * * * *